US006598593B1

(12) United States Patent
Kanamaru et al.

(10) Patent No.: US 6,598,593 B1
(45) Date of Patent: Jul. 29, 2003

(54) MOUNTING STRUCTURE FOR A FUEL SUPPLY APPARATUS

(75) Inventors: Shigeki Kanamaru, Tokyo (JP); Hideo Horibe, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/869,803

(22) PCT Filed: Nov. 4, 1999

(86) PCT No.: PCT/JP99/06120

§ 371 (c)(1),
(2), (4) Date: Sep. 27, 2001

(87) PCT Pub. No.: WO01/33068

PCT Pub. Date: May 10, 2001

(51) Int. Cl.[7] ..... F02M 37/04
(52) U.S. Cl. ..... 123/509; 123/514
(58) Field of Search ..... 123/509, 510, 123/514, 516; 137/565, 571, 574

(56) References Cited

U.S. PATENT DOCUMENTS 4,974,570 A * 12/1990 Szwargulski et al. ..... 123/509
5,050,567 A * 9/1991 Suzuki ..... 123/514
5,593,287 A * 1/1997 Sadakata et al. ..... 417/366
5,797,376 A * 8/1998 Frank et al. ..... 123/509
6,062,203 A * 5/2000 Takahashi et al. ..... 123/509
6,220,227 B1 * 4/2001 Okada et al. ..... 123/509

FOREIGN PATENT DOCUMENTS

| | | | |
|---|---|---|---|
| JP | 3-97567 | * 10/1991 | |
| JP | 10-311262 | 11/1998 | ..... F02M/37/10 |
| WO | 96/23967 | 8/1996 | ..... F02M/37/22 |

* cited by examiner

*Primary Examiner*—Carl S. Miller
(74) *Attorney, Agent, or Firm*—Sughrue Mion, PLLC

(57) ABSTRACT

A fuel supply apparatus mounting structure in which a set plate for holding a fuel supply apparatus is not corroded or deteriorated by the exposure to salt for thawing snow sprayed in winter in cold districts or to salt particles contained in sea wind in coastal areas is provided. The fuel supply apparatus mounting structure comprises a fuel pump 2 disposed within a fuel tank for pumping fuel to an internal combustion engine, a set plate 3 made of a synthetic resin and holding the fuel pump 2 and closing an opening hole 1*a* in the fuel tank 1, a gasket for maintaining airtight between the set plate 3 and the fuel tank 1, and a plate 4 for fastening the set plate 3 to the fuel tank 1, and a protective member 6, 8 made of a material which is not reacted, dissolved or deteriorated by a reaction product generated by a chemical reaction occurring between the plate 4 and the set plate 3 is inserted.

7 Claims, 4 Drawing Sheets

MOUNTING STRUCTURE FOR A FUEL SUPPLY APPARATUS

TECHNICAL FIELD

This invention relates to a fuel supply apparatus and, more particularly, to a mounting structure for a fuel supply apparatus for supplying fuel from a fuel tank to a fuel consuming apparatus such as an internal combustion engine.

BACKGROUND ART

FIG. 5 is a structural diagram showing the conventional fuel supply apparatus disclosed in Japanese Patent Laid-Open No. 10-31126, for example. FIG. 6 is an enlarged view of a portion A of FIG. 5. In FIGS. 5 and 6, 1 is a fuel tank, 2 is a fuel pump for pumping the fuel to an internal combustion engine, and 3 is a set plate made of a synthetic resin for supporting the fuel pump 2 and the like. The set plate 3 is provided to close an opening hole 1*a* disposed in the top surface of the fuel tank 1 with a gasket 5 made of synthetic rubber for maintaining a seal between the fuel tank 1 and the set plate 3 interposed therebetween, and the set plate 3 is secured thereto by tightening bolts 7 to fasten a holding plate 4 which holds an outer peripheral portion of the set plate 3 to the top of the fuel tank 1.

The material used commonly in forming the set plate 3 is polyacetal resin, or polyoxymethylene (hereinafter referred to as POM) resin. The material used commonly in forming the plate 4 is iron sheet or iron sheet plated with zinc.

In such the conventional mounting structure for the fuel supply apparatus, the set plate 3 made of POM resin and the plate 4 made of iron or iron plated with zinc are in direct contact with each other. The fuel tank 1 is generally mounted under the floor of an automobile body, so that the plate 4 exposed outside of the fuel tank is exposed to salt sprayed for thawing snow during winter in cold districts and to salt particles in sea wind in coastal areas. Under these environmental circumstances, chemical reactions that could take place on the surface of the plate 4 will be explained in conjunction with reaction formulae (1) to (8) given below.

$$Fe+CaCl_2 \rightarrow FeCl_2+Ca \quad \text{formula (1)}$$

$$Zn+CaCl_2 \rightarrow ZnCl_2+Ca \quad \text{formula (2)}$$

$$Fe+2NaCl \rightarrow FeCl_2+2Na \quad \text{formula (3)}$$

$$Zn+2NaCl \rightarrow ZnCl_2+2Na \quad \text{formula (4)}$$

$$FeCl_2+H_2O \rightarrow HCl+Fe.(OH)(Cl) \quad \text{formula (5)}$$

$$ZnCl_2+H_2O \rightarrow HCl+Zn.(OH)(Cl) \quad \text{formula (6)}$$

$$HCl \rightarrow H^+ + Cl^- \quad \text{formula (7)}$$

$$-(CH_2-O)-_nH^+ \rightarrow \text{decomposes to monomer} \quad \text{formula (8)}$$

On the surface of the plate 4 made of iron or zinc-plated iron, iron oxide or zinc chloride would be generated as a result of a chemical reaction with calcium chloride in salt for thawing snow or with sodium chloride in seawater as shown in reaction formulae (1) to (4).

In addition, iron oxide or zinc chloride thus generated reacts with water as shown in reaction formulae (5) or (6) and generates hydrochloric acid. When hydrochloric acid deposits on the set plate 3 made of POM resin, the C—O bond cleavage would take place in the POM resin due to the presence of the acid ($H^+$) as shown in reaction formulae (7) and (8), leading to decomposition of the resin. Thus, the set plate 3 has a problem of potential surface corrosion or deterioration.

This invention has been made to resolve the problem described above, and has as its object the provision of a fuel supply apparatus mounting structure in which the set plate for fitting a fuel supply apparatus is free from the problem of corrosion or deterioration.

DISCLOSURE OF INVENTION

The present invention resides in a mounting structure for a fuel supplying apparatus for mounting a fuel pump, which pumps fuel to an internal combustion engine, to an opening hole in a fuel tank to close the opening hole, comprising, a set plate made of a synthetic resin for supporting the fuel pump and placed over the opening hole in the fuel tank, a gasket disposed between the set plate and the fuel tank, and a gasket disposed between the set plate and the plate for maintaining a fluid tight relationship therebetween and the structure is characterized in that a protective member, which is made of a material that is not reacted, dissolved or deteriorated by a reaction product generated by a chemical reaction between the plate and the set plate, is inserted between the plate and the set plate. The plate may be made of an iron sheet or zinc plated iron sheet and said set plate may be made of polyacetal resin. The protective member may be formed as an integral, one-piece structure with said gasket, a coating layer formed on said plate, a synthetic rubber or epoxy resin.

BEST MODE FOR CARRYING OUT THE INVENTION

Figure 1:
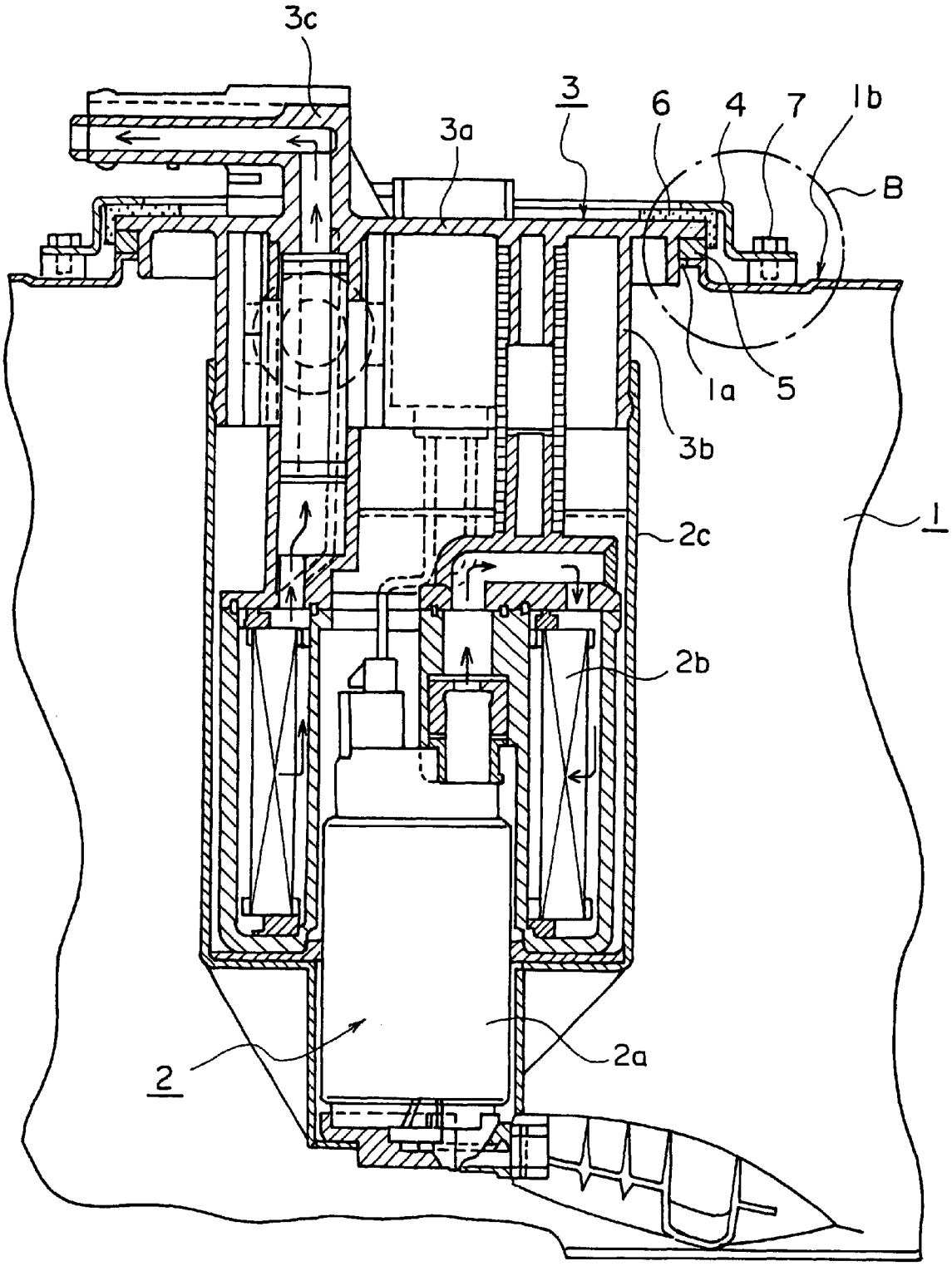
FIG. 1 is a sectional view of the fuel supply apparatus being mounted to the fuel tank via the mounting structure of the present invention.
Figure 2:
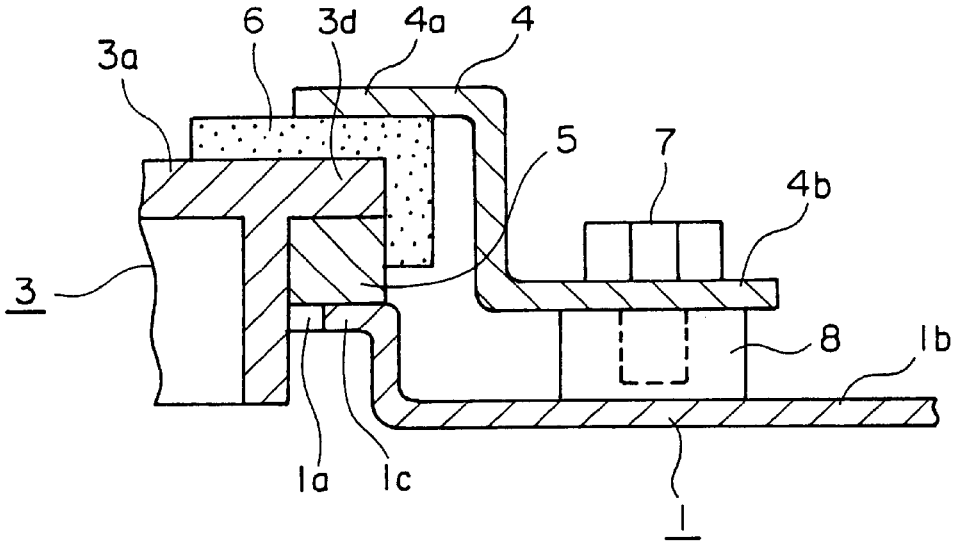
FIG. 2 is an enlarged partial sectional side view of Section B of FIG. 1 showing the fuel supply apparatus mounting structure of the present invention.

FIG. 1 is a structural diagram showing the fuel supply apparatus of one embodiment of the present invention. FIG. 2 is an enlarged view of Section B of FIG. 1. In FIGS. 1 and 2, 1 is a fuel tank having an opening hole 1*a* having a peripheral portion 1*c* in its top plate 1*b*. A set plate 3 is provided for closing the opening hole 1*a* and holding a fuel pump 2 which pumps fuel to an unillustrated internal combustion engine within the fuel tank 1. The fuel pump 2 is an assembly having a pump 2*a*, a fuel filter 2*b* and the like within a case 2*c* and may be of any known type.

The set plate 3 is a substantially circular member made of a synthetic resin such as polyacetal resin, such as POM resin, and comprises a disc-shaped main body 3*a*, a support member 3*b* integrally extending from the main body 3*a* to support the fuel pump 2, and a fuel supply pipe 3*c* formed integrally with the main body 3*a* and connected to the fuel pump 2. While an outer circumferential portion 3*d* of the main body 3*a* of the set plate 3 is placed over the peripheral edge portion 1*c* defining the opening 1*a* of the fuel tank 1 so that the opening hole 1*a* in the top of the fuel tank 1 is closed, an annular gasket 5 made of a synthetic rubber, such as nitrile rubber with PVC is inserted between the outer circumferential portion 3*d* of the set plate 3 and the peripheral edge portion 1*c* of the opening hole 1*a* of the fuel tank 1, thereby to maintain an air tight relationship between the fuel tank 1 and the set plate 3.

As best shown in FIG. 2, placed over the outer circumferential portion 3*d* of the set plate 3 is a ring-shaped protective member 6 having a substantially L-shaped cross section which extends not only to the top surface of the main body 3*a* but also to the outer circumferential surface of the gasket 5. As already described, the protective member 6 is made of a material that does not react, corrode or deteriorate despite the presence of hydrochloric acid that could be generated when iron oxide or zinc chloride reacts with water. Suitable materials for such the member include non-metallic materials that usually exhibits resistance to hydrochloric resistant and, particularly, to synthetic resins such as epoxy resin, synthetic rubber and other.

Placed on such the protective member 6 is the plate 4 made of, for instance, iron sheet or iron sheet plated with zinc and fastened to the top surface 1*b* of the fuel tank 1 by bolts 7 via spacers 8. In the illustrated embodiment, the plate 4 is a ring-shaped member of a crank-shaped cross section which holds the set plate 3 at the inner peripheral edge portion 4*a* with the protective member 6 placed therebetween, while the outer peripheral edge portion 4*b* is secured to the top surface 1*b* of the fuel tank 1 by the bolts 7 with the spacers 8.

In this embodiment, the protective member 6 or an intervening substance made of a synthetic rubber is inserted between the set plate 3 made of a synthetic resin such as POM resin and the plate 4 made of an iron sheet or a zinc-plated iron sheet, so that the set plate 3 and the plate 4 do not come into a direct contact with each other. Therefore, although iron and zinc in the surface of the plate 4 may react with calcium chloride contained in salt for thawing snow and sodium chloride contained in seawater according to the chemical reactions of formulae (1) to (4) to form iron oxide and zinc chloride, and the formed iron oxide and zinc chloride may react with water as shown in the chemical reactions of formulae (5) and (6) to possibly generate hydrochloric acid, since the protective member 6 made of a synthetic rubber covers the outer circumferential surface of the set plate 3, the hydrochloric acid never attaches to the set plate 3, whereby the set plate 3 is not reacted, dissolved or deteriorated.

Figure 3:
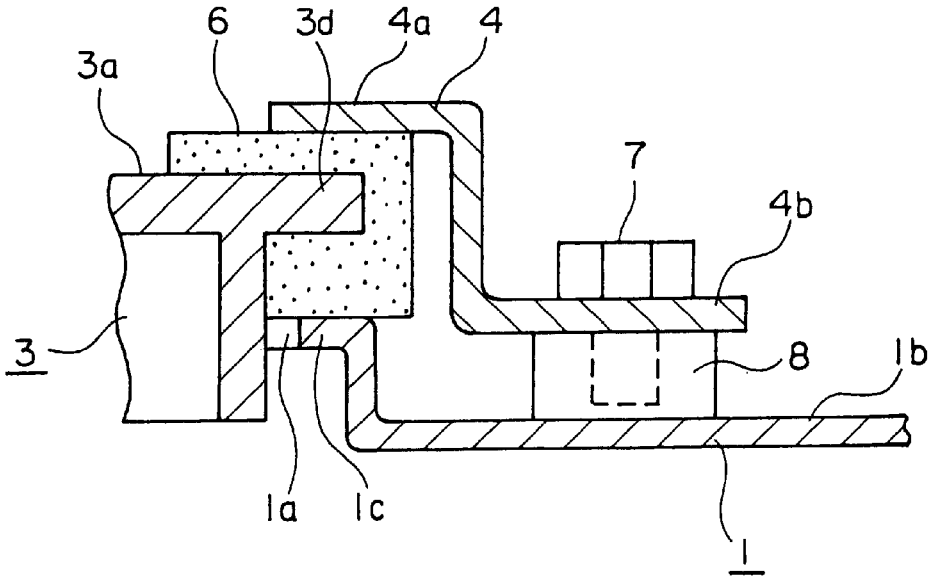
FIG. 3 is a partial sectional view showing another embodiment of the present invention.

FIG. 3 shows another embodiment of the mounting structure for the fuel supply apparatus of the present invention. In the embodiment shown in FIGS. 1 and 2, the protective member 6 and the gasket 5 are separate components, while in the embodiment shown in FIG. 3, the gasket 5 is made of the same material as the protective member 6 and is integrally formed to have a substantially U-shaped cross section, wherein the outer circumferential portion 3*d* of the set plate 3 is inserted in the space between the two legs of the U-shaped member. Needless to say, the gasket 5 may be extended to form an integral protective member to serving as the protective member 6 since any such member of this construction would have an effect similar to that provided by the previously discussed embodiment for the reason described above, as long as the gasket 5 is made of a material resistant to hydrochloric acid as previously discussed.

Figure 4:
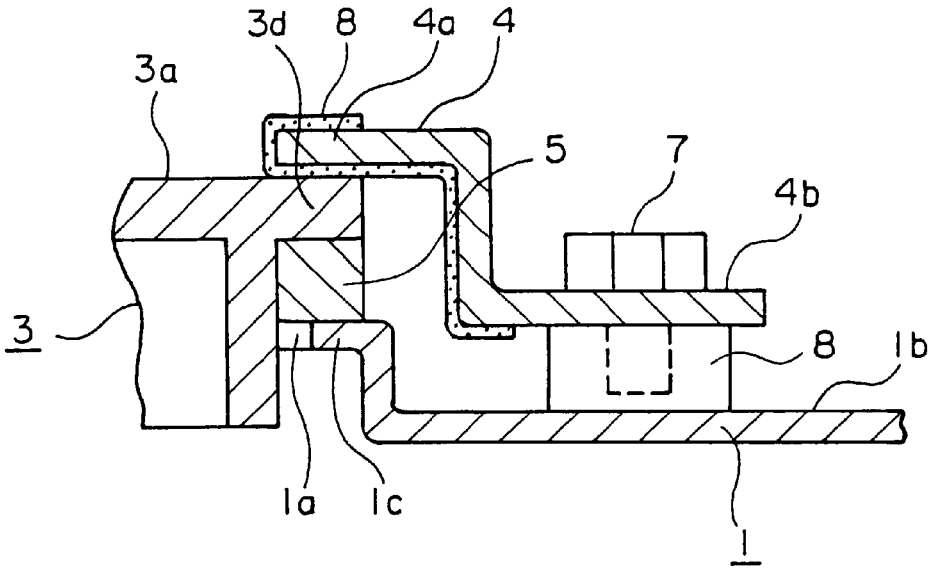
FIG. 4 is a partial sectional view showing a still another embodiment of the present invention.
Figure 6:
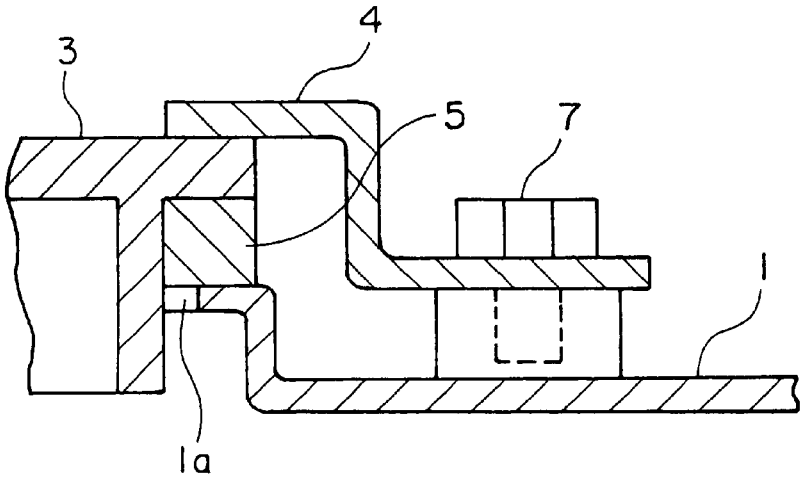
FIG. 6 is a partial enlarged sectional view of Section A of FIG. 5 showing a conventional mounting structure.
Figure 5:
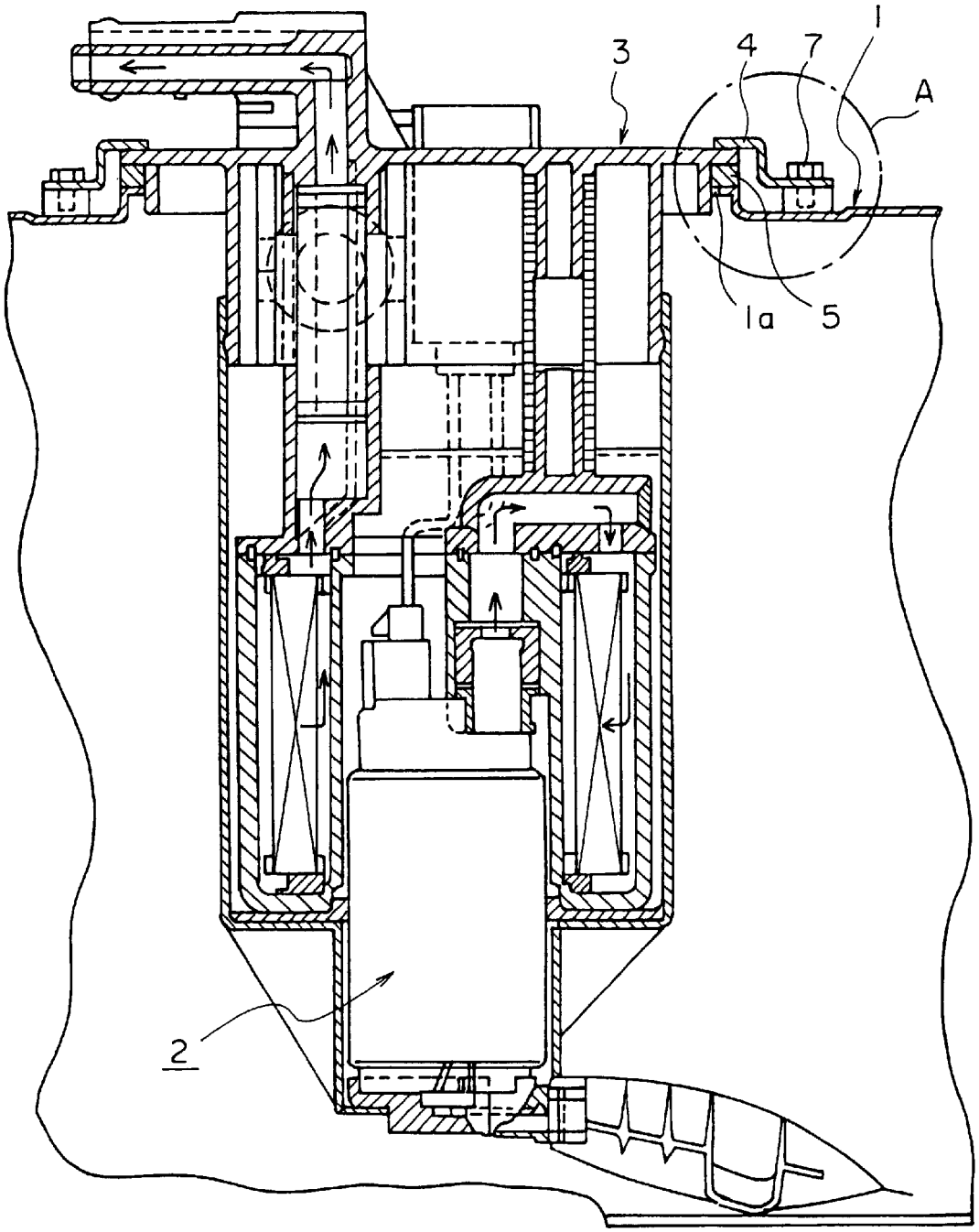
FIG. 5 is a sectional view of the fuel supply apparatus mounted to the fuel tank via a conventional mounting structure.

In yet another embodiment shown in FIG. 4, a coating 8 of an epoxy resin paint or the like is formed by painting for example as a protective member not on the set plate 3 but on the surface of the plate 4 facing to the set plate 3 and its vicinity. In the illustrated embodiment, the coating 8 is formed on the surface of the plate 4 facing the set plate 3 and a portion of the outer surface of the inner peripheral edge portion 4*a* of the plate 4. With this construction, the set plate 3 and the plate 4 do not directly contact with each other because of the coating 8, so that similar advantageous effects to those of the previous embodiments can be obtained and the number of components needed to be assembled can be decreased.

INDUSTRIAL APPLICABILITY

As discussed, the fuel supply apparatus mounting structure of the present invention is useful as a structure for mounting a fuel supply apparatus in a fuel tank.

What is claimed is:

1. A mounting structure for a fuel supplying apparatus for mounting a fuel pump for pumping fuel to an internal combustion engine to an opening hole in a fuel tank to close the opening hole, comprising;

a first plate made of a synthetic resin for supporting said fuel pump and placed over the opening hole in said fuel tank;

a gasket disposed between said first plate and said fuel tank; and a second plate made of an iron sheet or a zinc-plated iron sheet for holding said first plate on said fuel tank; characterized in that a protective member, which is made of a material that is not reacted, dissolved or deteriorated by a reaction product generated by a chemical reaction between said second plate and said first plate, is inserted between said second plate and said first plate.

2. A mounting structure for a fuel supplying apparatus as claimed in claim 1, wherein said first plate is made of polyacetal resin.

3. A mounting structure for a fuel supplying apparatus as claimed in claim 1, wherein said protective member is formed as an integral, one-piece structure with said gasket.

4. A mounting structure for a fuel supplying apparatus as claimed in claim 1, wherein said protective member is a coating layer formed on said plate.

5. A mounting structure for a fuel supplying apparatus as claimed in claim 1, wherein said protective member is made of a synthetic rubber.

6. A mounting structure for a fuel supplying apparatus as claimed in claim 1, wherein said protective member is made of epoxy resin.

7. A mounting structure for a fuel supplying apparatus as claimed in claim 1, wherein said first plate and said second plate are disposed so as to not come into direct contact with each other.

* * * * *